US009417019B2

(12) United States Patent
Norton

(10) Patent No.: US 9,417,019 B2
(45) Date of Patent: Aug. 16, 2016

(54) FIRE CONTROL FOR AUTO-LOADING SHOTGUN

(71) Applicant: RA BRANDS, L.L.C., Madison, NC (US)

(72) Inventor: Vincent Norton, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 13/792,669

(22) Filed: Mar. 11, 2013

(65) Prior Publication Data

US 2014/0053716 A1 Feb. 27, 2014

Related U.S. Application Data

(60) Provisional application No. 61/692,952, filed on Aug. 24, 2012.

(51) Int. Cl.

| | |
|---|---|
| ***F41A 9/61*** | (2006.01) |
| ***F41A 9/64*** | (2006.01) |
| ***F41A 3/58*** | (2006.01) |

(Continued)

(52) U.S. Cl.

CPC ... *F41A 9/64* (2013.01); *F41A 3/58* (2013.01); *F41A 9/18* (2013.01); *F41A 9/72* (2013.01)

(58) Field of Classification Search

CPC ..... F41A 9/64; F41A 9/72; F41A 9/18; F41A 9/38; F41A 3/12; F41A 3/58

USPC ..... 89/33.1

See application file for complete search history.

(56) References Cited

U.S. PATENT DOCUMENTS

| | | | |
|---|---|---|---|
| 1,550,758 | A | 8/1925 | Swebilius |
| 2,418,946 | A | 4/1947 | Loomis |

(Continued)

FOREIGN PATENT DOCUMENTS

| | | | |
|---|---|---|---|
| EP | 1345000 | A1 | 9/2003 |
| FR | 1235856 | | 11/1960 |

(Continued)

OTHER PUBLICATIONS

International Search Report dated Feb. 4, 2014 for International Application PCT/US2013/055704 filed Aug. 20, 2013.

(Continued)

*Primary Examiner* — Michelle R Clement

(74) *Attorney, Agent, or Firm* — Womble Carlyle Sandridge & Rice, LLP

(57) ABSTRACT

An auto-loading firearm includes a bolt assembly that is both automatically operable and manually operable between a forward position closing the chamber of the firearm and a rearward position opening the chamber, and a fire control mechanism. The fire control mechanism comprises a trigger plate assembly operably located between the chamber and a magazine that is capable of housing one or more additional rounds of ammunition. The trigger plate assembly includes a latch release and a carrier that is operable to lift a round from the magazine to the chamber. The fire control mechanism further includes a feed latch that is operable to release of a round from the magazine onto the carrier when disengaged by the latch release. The trigger plate assembly and the feed latch are configurable to control the release of rounds of ammunition from the magazine during manual operation of the fire control.

9 Claims, 10 Drawing Sheets

(51) Int. Cl.
*F41A 9/18* (2006.01)
*F41A 9/72* (2006.01)

(56) References Cited

U.S. PATENT DOCUMENTS

| | | | | | |
|---|---|---|---|---|---|
| 2,562,037 | A | | 7/1951 | Humeston | |
| 2,675,638 | A | | 4/1954 | Crittendon | |
| 2,685,754 | A | | 8/1954 | Crittendon et al. | |
| 2,765,557 | A | | 10/1956 | Roper | |
| 2,827,728 | A | | 3/1958 | Simmons | |
| 2,926,446 | A | | 3/1960 | Benson | |
| 3,201,886 | A | | 8/1965 | Kelly et al. | |
| 3,285,133 | A | | 11/1966 | Fowler | |
| 3,368,298 | A | | 2/1968 | Browning | |
| 3,389,487 | A | | 6/1968 | Benelli | |
| 3,397,473 | A | | 8/1968 | Browning | |
| 3,631,621 | A | | 1/1972 | Tito | |
| 3,680,433 | A | | 8/1972 | Tollinger | |
| 3,789,730 | A | | 2/1974 | Helmes | |
| 3,866,513 | A | | 2/1975 | Hornfeck et al. | |
| 3,919,800 | A | * | 11/1975 | Browning | 42/17 |
| 3,996,684 | A | | 12/1976 | Bauman et al. | |
| 3,996,685 | A | * | 12/1976 | Bauman et al. | 42/17 |
| 4,014,247 | A | | 3/1977 | Tollinger | |
| 4,044,487 | A | | 8/1977 | Hutton et al. | |
| 4,141,276 | A | | 2/1979 | Taylor et al. | |
| 4,344,246 | A | | 8/1982 | Bauman et al. | |
| 4,389,919 | A | | 6/1983 | Kast et al. | |
| 4,445,292 | A | | 5/1984 | Martin | |
| 4,516,466 | A | | 5/1985 | Jennie | |
| 4,856,217 | A | | 8/1989 | Benelli | |
| 4,867,039 | A | | 9/1989 | Dobbins | |
| 5,373,775 | A | | 12/1994 | Findlay, Sr. et al. | |
| 5,463,828 | A | | 11/1995 | Andrejevic | |
| 5,551,180 | A | | 9/1996 | Findlay et al. | |
| 5,682,007 | A | | 10/1997 | Dobbins | |
| 5,718,074 | A | | 2/1998 | Keeney | |
| 5,740,516 | A | | 4/1998 | Jiranek, II et al. | |
| 5,771,620 | A | | 6/1998 | Crawford et al. | |
| 5,806,226 | A | | 9/1998 | Norton et al. | |
| 5,918,401 | A | | 7/1999 | Rowlands | |
| 6,044,580 | A | | 4/2000 | Gussalli Beretta | |
| 6,347,569 | B1 | | 2/2002 | Butler | |
| 6,393,961 | B1 | | 5/2002 | Ockenfuss | |
| 6,418,655 | B1 | | 7/2002 | Kay | |
| 6,564,691 | B2 | | 5/2003 | Butler | |
| 6,612,062 | B1 | | 9/2003 | Howard et al. | |
| 6,732,465 | B2 | | 5/2004 | Strayer | |
| 7,000,345 | B1 | | 2/2006 | Kay | |
| 7,107,715 | B2 | | 9/2006 | Keeney et al. | |
| 7,533,598 | B1 | | 5/2009 | Murphy | |
| 7,707,923 | B2 | | 5/2010 | Gussalli Beretta | |
| 8,079,168 | B2 | | 12/2011 | Lesenfants | |
| 8,733,009 | B2 | * | 5/2014 | Ricks | 42/21 |
| 2004/0200110 | A1 | * | 10/2004 | Greenhut | 42/18 |
| 2011/0308126 | A1 | | 12/2011 | Lesenfants | |
| 2012/0204712 | A1 | | 8/2012 | Hauck | |

FOREIGN PATENT DOCUMENTS

| | | | |
|---|---|---|---|
| WO | WO 2012/053943 | A2 | 4/2012 |
| WO | WO 2014-031590 | A1 | 2/2014 |

OTHER PUBLICATIONS

Written Opinion dated Feb. 4, 2014 for International Application PCT/US2013/055704 filed Aug. 20, 2013.

J. C. Higgins Bolt Action Shotgun Model 11: List of Parts and Assemblies; 4 pages; May 1957; Sears, Roebuck and Co. and Simpson-Sears Limited.

* cited by examiner

FIRE CONTROL FOR AUTO-LOADING SHOTGUN

RELATED APPLICATIONS

The present Patent Application is a formalization of previously filed, co-pending U.S. Provisional Patent Application Ser. No. 61/691,952, filed Aug. 24, 2012 by the inventor named in the present Application. This Patent Application claims the benefit of the filing date of the cited Provisional Patent Application according to the statutes and rules governing provisional patent applications, particularly 35 U.S.C. §119(a)(i) and 37 C.F.R. §1.78(a)(4) and (a)(5). The specification and drawings of the Provisional Patent Application referenced above are specifically incorporated herein by reference as if set forth in their entirety.

TECHNICAL FIELD

The present invention relates generally to a fire control mechanism, and in particular to a fire control mechanism for auto-loading type firearms that is configurable to control the feeding and release of rounds of ammunition from the magazine of the firearm during manual operation of the bolt assembly.

BACKGROUND

Auto-loading firearms generally carry multiple rounds of ammunition or shells that are stored in a magazine. The magazine can be fixed to the firearm or removably attached to the firearm near the receiver. In firearms such as auto-loading shotguns, a feed latch mechanism will generally lock the bolt in an open position after firing of the last round of ammunition from the firearm. In some firearm models, this latch mechanism will remain in a locked position that can block loading of additional rounds, even after the action is closed, until a release button for the latch is engaged. While this apparently-simple task can be accomplished in a variety of ways, it is desirable that the firearm be secured in as simple and intuitive manner as possible, with a minimal use of levers, switches or buttons, and with a procedure and access that is easily accomplished by a shooter wearing gloves. The same concerns apply to the re-loading of the round and releasing the bolt to close and lock the round into the chamber. Accordingly, a need exists for an improved feed latch mechanism that addresses the foregoing and other related and unrelated problems in the art.

BRIEF DESCRIPTION OF THE DRAWINGS

These and various other advantages, features, and aspects of the present invention will become apparent and more readily appreciated from the following detailed description of the embodiments taken in conjunction with the accompanying drawings, as follows.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

The following description is provided as an enabling teaching of exemplary embodiments. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances, and are a part of the invention. Thus, the following description is provided as illustrative of the principles of the embodiments and not in limitation thereof, since the scope of the invention is defined by the claims.

Illustrated in FIGS. 1-16 are various representative embodiments of a fire control mechanism and system for an auto-loading firearm, here shown as an auto-loading shotgun, according to the principles of the present disclosure. The illustrated embodiments also include various configurations and methods for controlling the release of rounds of ammunition from the magazine of the firearm during manual cycling of the fire control mechanism. As described below, the fire control mechanism of the present disclosure provides several significant advantages and benefits over other systems and methods for operating auto-loading shotguns and various other, similar firearms. However, the recited advantages are not meant to be limiting in any way, as one skilled in the art will appreciate that other advantages may also be realized upon practicing the present disclosure.

Figure 1:
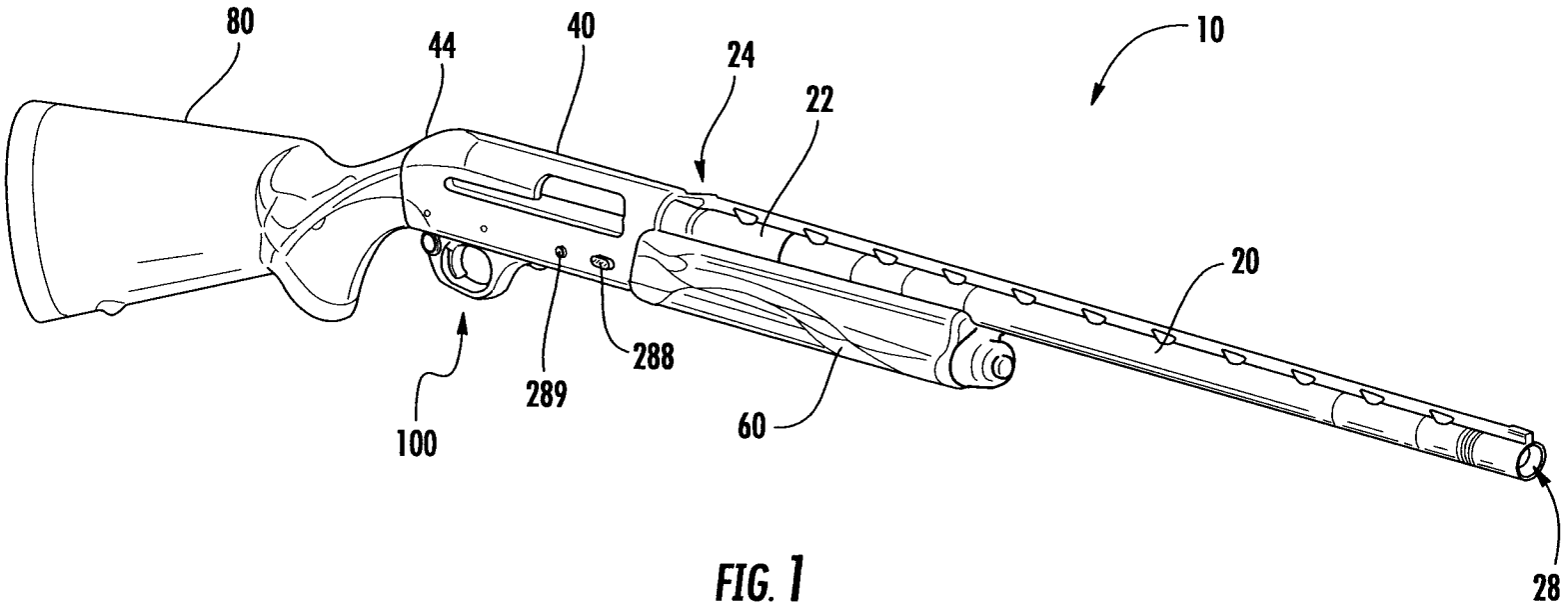
FIG. 1 is a perspective view of a firearm including a fire control mechanism, in accordance with a representative embodiment of the disclosure.

An auto-loading shotgun 10 in accordance with one embodiment of the present disclosure is shown in FIG. 1. The shotgun 10 generally includes a barrel 20 having bore 28 extending through the length thereof, and a chamber 24 at its rear or breech end 22 for receiving and holding a round of ammunition, such as a shotgun shell, during firing. The shotgun also includes a magazine 60 for storing rounds of ammunition for loading into the chamber 24, a receiver 40 which supports and houses the fire control mechanism 100, and a gun stock 80 attached to the back end 44 of the receiver. Additional feed latch control buttons 288, 289, the operation of which will be discussed in greater detail below, are also visible.

Figure 2:
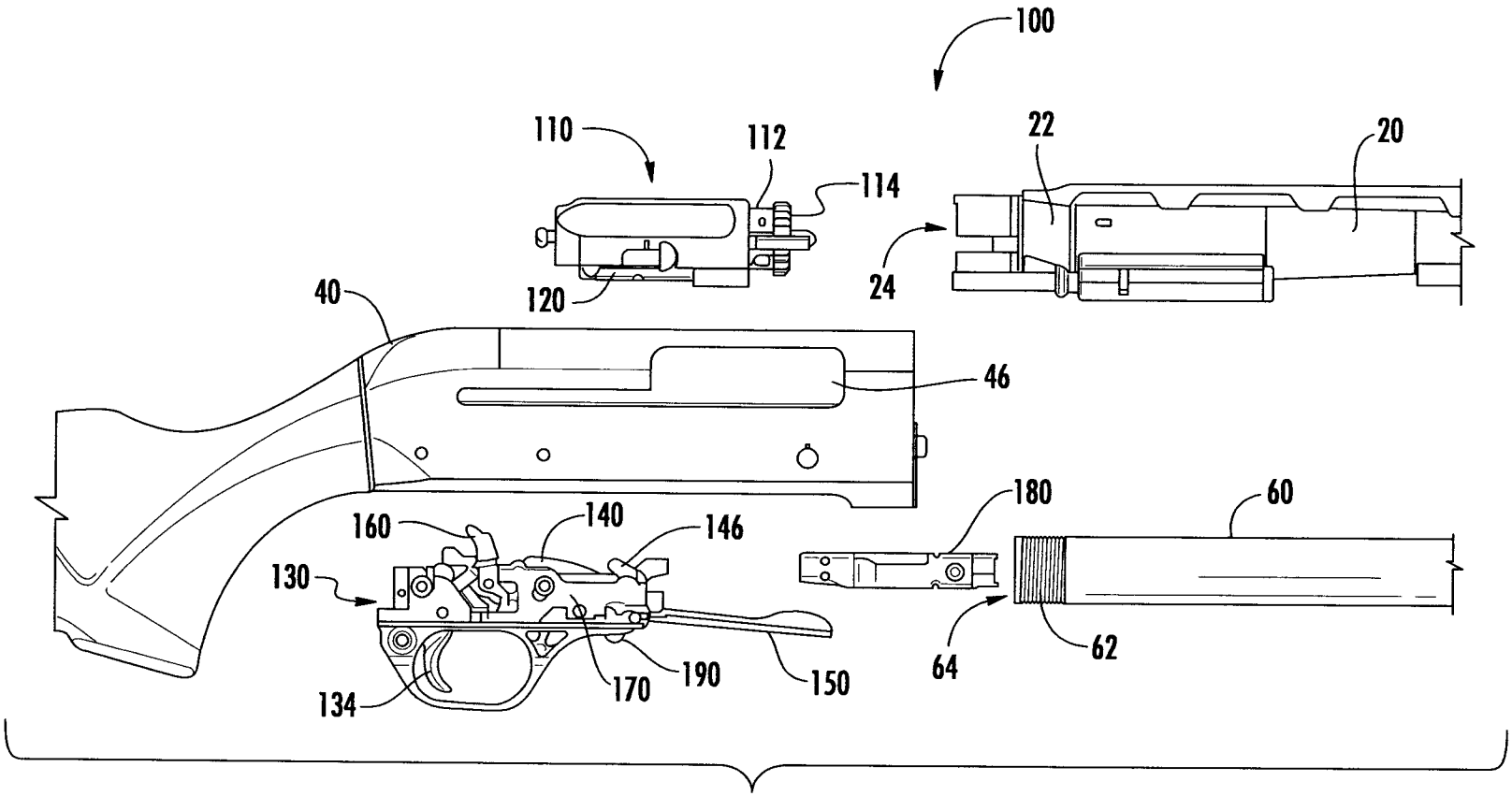
FIG. 2 is an exploded side view of the fire control mechanism and associated components of the firearm of FIG. 1.

As shown in the exploded side view provided in FIG. 2, the fire control mechanism 100 includes various components or sub-assemblies that are supported within or proximate to the receiver 40. For example, the fire control mechanism includes a bolt assembly 110 having a bolt body 112 with a bolt head 114 that can be coupled into the back end 22 of the barrel 20 to seal the chamber 24 during firing. The bolt body 112 typically rides on the bolt carrier 120, and upon firing of the firearm is moved rearward to open the chamber and release the round through an ejection port 46 in the receiver 40.

The fire control mechanism 100 also includes a trigger plate assembly 130 which is operably located between the chamber 24 of the barrel 20 and the opening 64 in the back end 62 of the magazine 60. The trigger plate assembly includes a trigger 134 and a hammer 140 which initiates the firing of the shotgun. The trigger plate assembly 130 also includes a carrier 150 that is operable to lift a round of ammunition from the magazine 60 to the chamber 24, and a carrier dog 160 configured to actuate and control the carrier 150. The trigger plate assembly 130 further includes a rotatable latch release 170 used to control the feeding of rounds from the magazine 60 onto the carrier 150, a latch release lever 146 used to actuate the latch release 170 during firing, and a magazine cutoff 190 for positioning the carrier 150 in various orientations to control the operation of the fire control mechanism 100 and to facilitate the loading/unloading of rounds into or from the magazine 60.

The fire control mechanism 100 further includes a feed latch 180 which can be directed to either block or allow the release of the additional rounds located in the magazine 60 onto the carrier 150, and/or to release the bolt assembly 110 from a locked-open position and allow the bolt assembly to slide forward to close around the chamber 24. The feed latch 180 can be a unitary feed latch mechanism or a two-piece feed latch assembly, as described below with reference to FIGS. 15-16.

As can be seen from the relative position of the component assemblies of the fire control mechanism 100 shown in FIG. 2, the bolt assembly 110 generally slides back and forth over the trigger plate assembly 130, which is located in the bottom, rear portion of the receiver 40. The feed latch 180 is located in the bottom, front portion of the receiver 40, adjacent one side of the carrier 150 and between the latch release 170 and the opening 64 in the back end 62 of the magazine 60.

Figure 3:
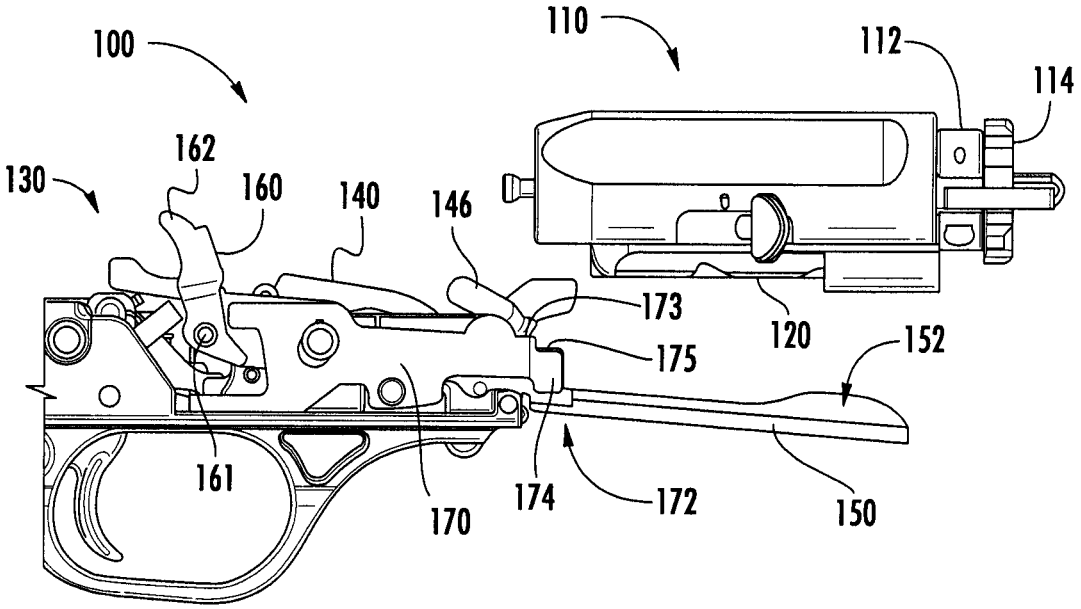
FIG. 3 is a side view of the trigger plate and bolt assemblies of the fire control mechanism of FIG. 2 in a "ready-to-fire" position.

FIG. 3 shows a side view of the isolated trigger plate assembly 130 and the bolt assembly 110 of the fire control mechanism 100 in a "ready-to-fire" position. In this position, the head 114 of the bolt body 112 is locked and secured into the chamber of the barrel (not shown), which also has a round loaded therein during normal operation. The carrier 150 and carrier dog 160 are also shown in their normally-biased positions, with the lifting portion 152 of the carrier 150 being lowered and ready to receive a round from the magazine (also not shown), and with the upper end 162 of the carrier dog being raised above the trigger plate assembly 130 and in the path of the bolt carrier 120. Also shown in FIG. 3, the hammer 140 generally is in its cocked position, while the latch release lever 146 rests in a neutral position above an upper step portion 173 formed into the forward end 172 of the latch release 170. The forward end 172 of the latch release 170 also includes an engaging surface or engaging portion 174 that engages with the back end 184 of the feed latch 180 (FIG. 10) when the latch release 170 is in its normally-biased and non-rotated position, as shown in FIG. 3. In this position, the engaging portion 174 is raised high enough to block the back end of the feed latch and prevent it from rotating over the carrier 150.

Figure 4:
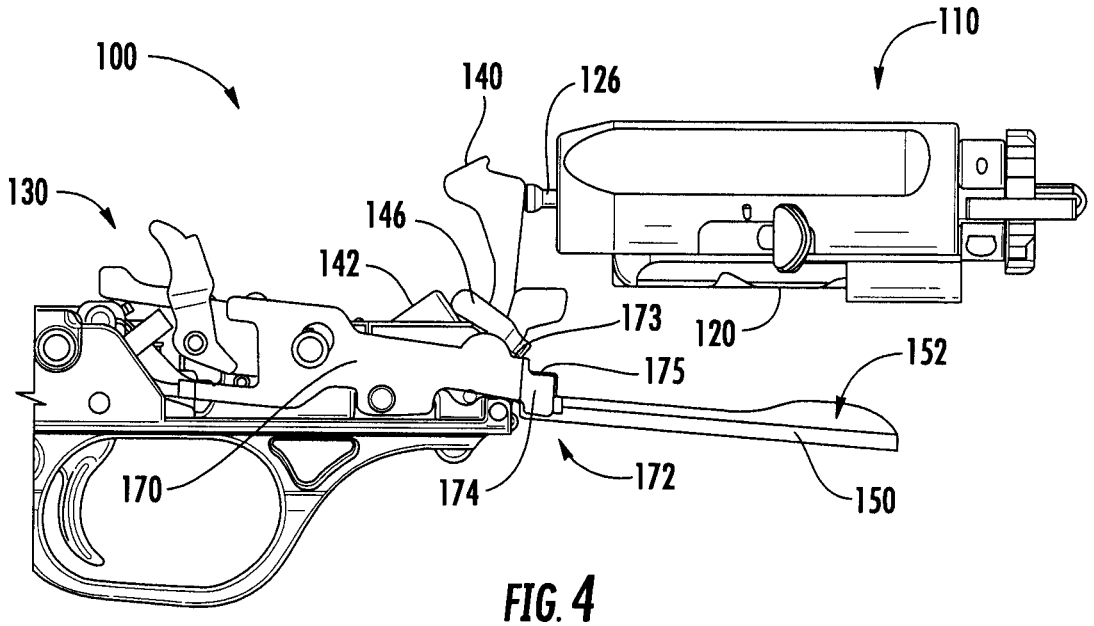
FIG. 4 is a side view of the trigger plate and bolt assemblies of the fire control mechanism of FIG. 2 in a firing position.

When the trigger is engaged, as illustrated in FIG. 4, the sear assembly located within the trigger mechanism releases the hammer 140 to rotate upwards under the influence of the spring-loaded hammer plunger 142, to strike the back end of the firing pin 126. This causes the firing pin 126 to slide forward and fire the round of ammunition located within the chamber. At the same time, the hammer plunger 142 also presses upwards against the back end of the latch release lever 146, causing the forward end of the latch release lever 146 to press downwardly on the upper step portion 173 of the latch release 170. In turn, this pressure causes the latch release 170 to rotate clockwise (as viewed from the right hand side of the firearm) and the engaging portion 174 to move downwardly far enough that the back end 184 of the feed latch 180 (FIGS. 8-9) is released to pivot over the lower step portion 175 formed into the forward end 172 above the engaging portion 174. As the back end 184 of the feed latch 180 pivots inwardly, it also moves over a lower step portion 155 (FIG. 5) formed into the carrier 150 and locks the carrier in the lowered position.

Thus, through the operation of the latch release lever 146, the latch release 170 of the firing mechanism 100 can be engaged and rotated closer in time to the moment of firing of the firearm, which in turn allows the feed latch 180 to pivot open sooner to release the next round from the magazine to slide onto the lifting portion 152 of the carrier 150. As a result, the use of the latch release lever 146 to initiate the loading of the next round onto the carrier 150 earlier in the firing cycle (e.g. near to the time of firing) rather than later in the firing cycle (e.g. after the bolt assembly 110 has ejected the fired round from the ejection port) can help loading operations and to minimize mis-loadings, which is when the next round fails to load automatically into the chamber.

Figure 5:
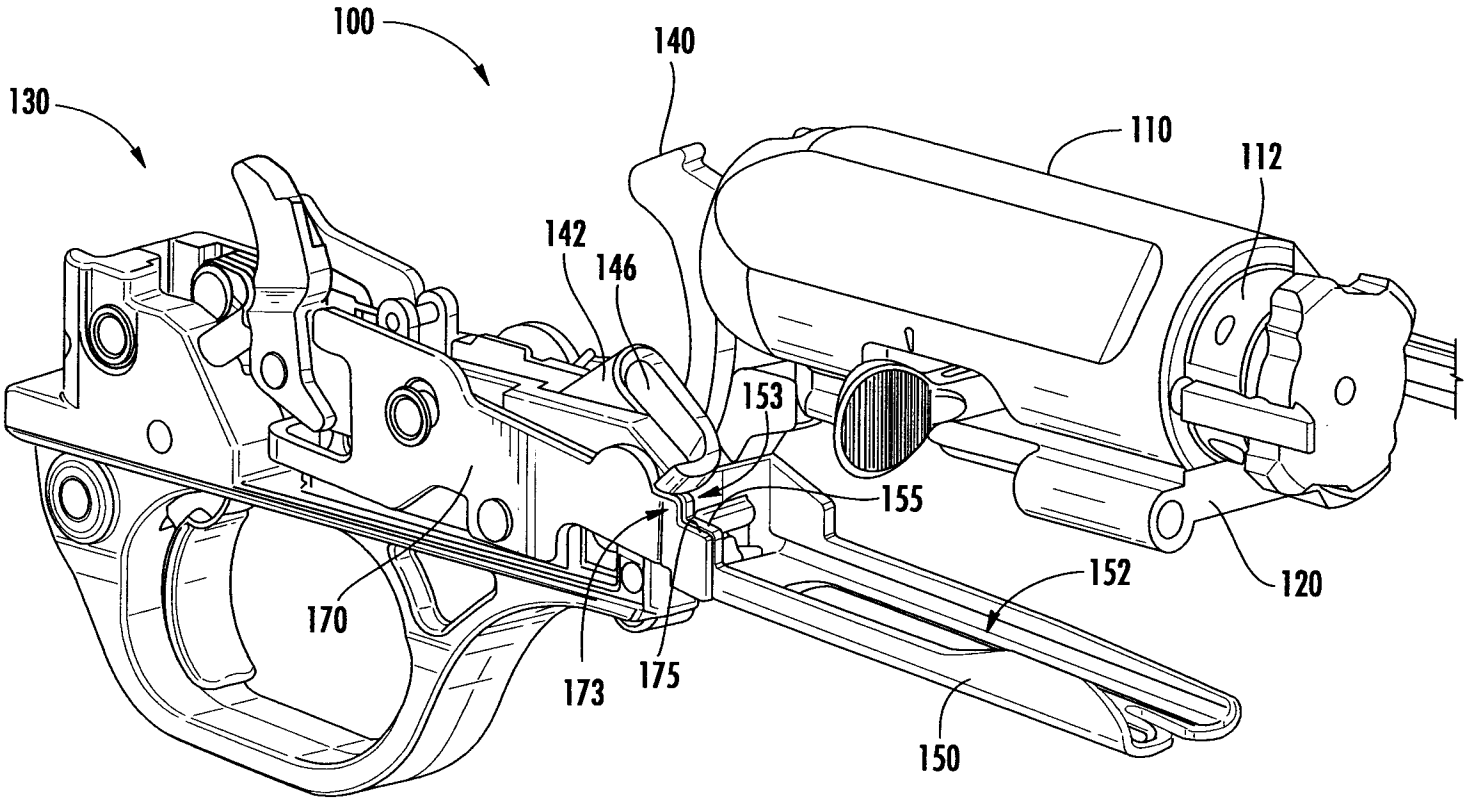
FIG. 5 is a perspective view of the trigger plate and bolt assemblies of the fire control mechanism of FIG. 2 in a firing position.

In addition, as illustrated FIG. 5, the latch release lever 146 also may be configured to press down on an upper step 153 of the carrier 150 simultaneous with its engagement with the upper step 173 of the latch release 170. This action can function to hold down and help stabilize, or control, the lifting portion 152 of the carrier 150 during firing. Otherwise, the lifting portion 152 of the carrier 150 may be susceptible to an undesirable "carrier bounce" created by the recoil forces during firing, which can cause the lifting portion 152 to momentarily move out of position and lead to a mis-loading of the next round from the magazine.

As will be explained in more detail below, if another round is present in the magazine during firing, the sequential movement of the latch release lever 146, the latch release 170, and the feed latch 180 (see FIGS. 8-9) causes the fresh round to be automatically loaded onto the lifting portion 152 of the carrier 150. As the fresh round is urged rearward onto the lifting portion 152 of the carrier 150 by the magazine spring, the raised lip at the base end of the round contacts and urges the back end 184 of the feed latch 180 outwardly so that it no longer covers the lower step 155 of the carrier 150 or the lower step 175 of the latch release 170, releasing the carrier 150 to again rotate.

At approximately the same time, the bolt assembly 110 moves backwards over the trigger plate assembly 130 (see FIG. 8) and ejects the spent round from the receiver while the bolt carrier 120 contacts and pushes the carrier dog 160 backward. This contact force rotates the carrier dog 160 counterclockwise relative to the carrier 150, since the carrier 150 is held in place by the back end 184 of the feed latch 180 that by now has moved over the lower step 155 proximate the lifting portion 152 of the carrier 150. The relative movement between the carrier dog 160 and the carrier 150 also creates a spring-loaded tension which can subsequently be used to help raise the fresh round being loaded onto the carrier 150 up to the chamber.

After the bolt assembly 110 has completed its rearward movement and begins to move forward toward the chamber, a notch 122 formed into the lower surface of the bolt carrier 120 engages with a projecting tab 163 extending from the upper end 162 of the carrier dog 160. With the fresh round on the carrier 150 having pushed the feed latch 180 outwardly, so that it no longer covers the lower step 155 and the carrier 150 is free to rotate, the bolt assembly 110 is able to push the carrier dog 160 downward and out of the way as it slides forward. This action, along with the release of the spring-loaded tension between the carrier dog 160 and the carrier 150, causes the lifting portion 152 of the carrier 150 to rotate upwardly to align the fresh round with the chamber of the barrel. The fresh round is then captured by the head 114 of the forward-moving bolt assembly 110 and loaded into the chamber as the fire control 110 completes the firing cycle and returns to the forward and locked, ready-to-fire position shown in FIG. 3.

Figure 6:
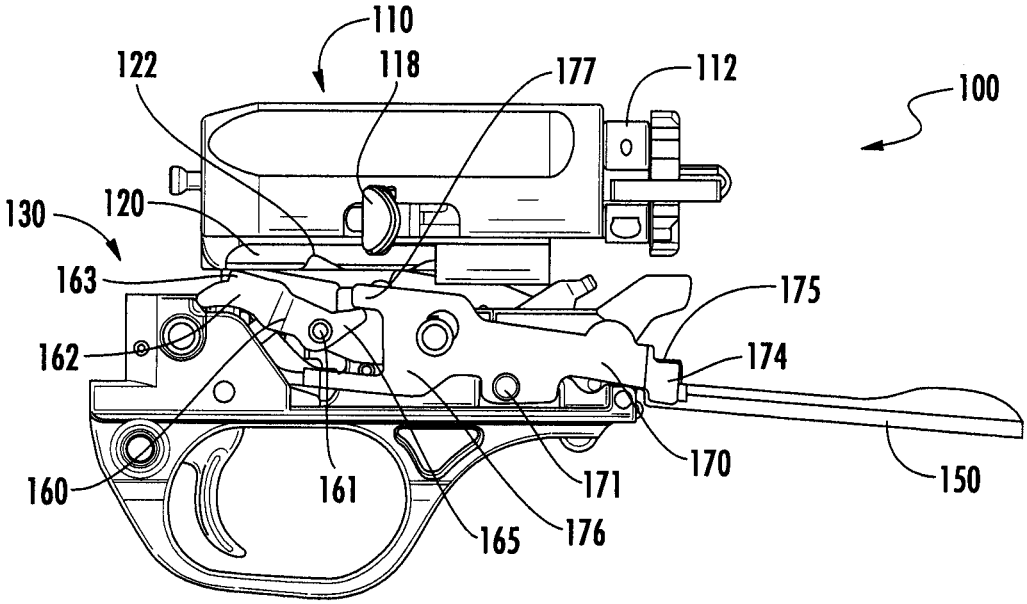
FIG. 6 is a side view of the trigger plate and bolt assemblies of the fire control mechanism of FIG. 2 in a first, manually-operated configuration.
Figure 7:
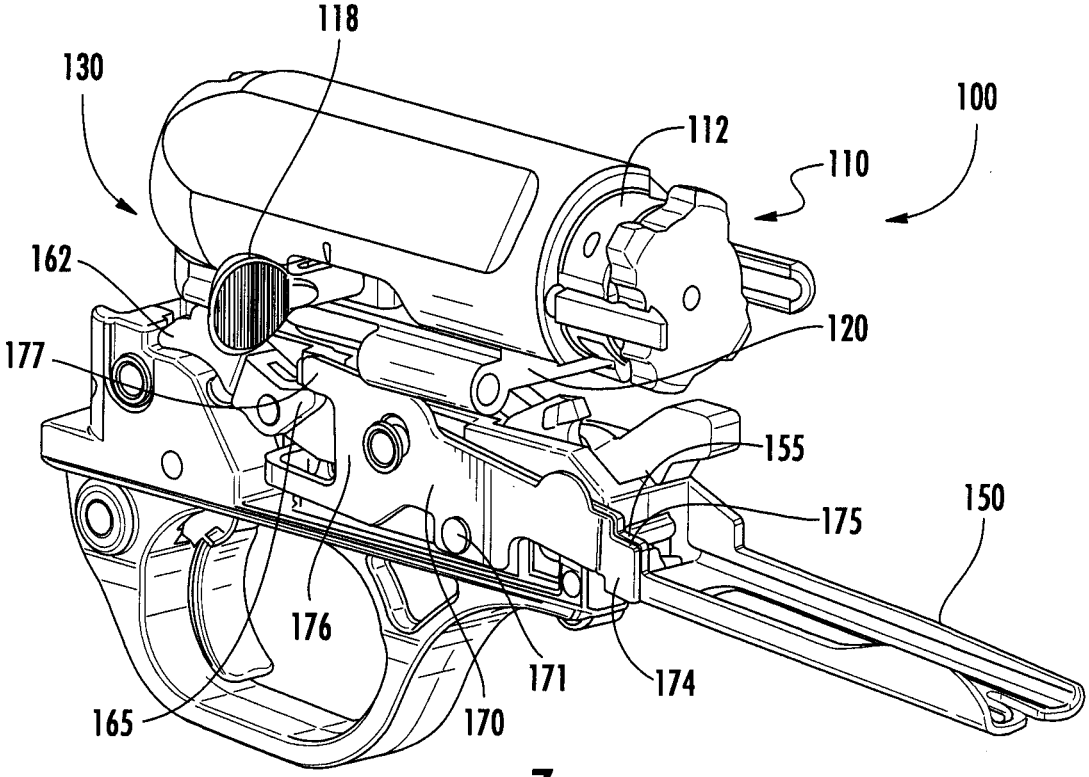
FIG. 7 is a perspective view of the trigger plate and bolt assemblies of the fire control mechanism of FIG. 2 in the first, manually-operated configuration.

The mechanical action that takes place during automatic cycling of the fire control mechanism 100 described above, in response to the firing of a round of ammunition, can differ from the mechanical action that takes place during manual cycling of the fire control mechanism. For instance, the hammer plunger 142 is not activated during manual cycling of the bolt assembly 110 from the forward, closed position (FIG. 4) to the rearward, open position. Consequently, during manual cycling the latch release lever 146 typically will not engage and move the latch release 170 and feed latch 180 to another round to feed onto the lifting portion 152 of the carrier 150. In the prior art, this action is often accomplished through the use of some additional button or lever which much be depressed by the shooter during manual cycling of the bolt assembly to rotate a latch release or feed latch and allow another round to feed onto the carrier. In accordance with the present disclosure, the action of feeding another round onto the carrier 150 during manual cycling of the bolt assembly 110 can be accomplished without necessarily requiring an additional button or lever to be depressed FIGS. 6 and 7 are side and perspective views, respectively, of the isolated trigger plate assembly 130 and bolt assembly 110 of the fire control mechanism 100 of FIG. 2 in a first configuration that allows the latch release 170 to be rotated and another round of ammunition to feed onto the carrier 150 during manual cycling of the bolt assembly 110, without the manipulation or use of an additional button or lever. For example, during manual cycling of the firearm the shooter pulls the bolt lever 118 rearwardly to unlock the bolt body 112 from the chamber and to cause the bolt assembly 110 to slide backwards over the trigger plate assembly 130. During its backward travel, the bolt carrier 120 contacts the upper end 162 of the carrier dog 160 and pushes it backward and downward to rotate the carrier dog about the carrier dog pivot pin 161 until the toe portion 165 of the carrier dog contacts a catch 177 in the back end 176 of the latch release 170, and pushes it upwards. This action causes rotation of the latch release 170 about the latch pin 171 until the lower step 175 proximate the engaging portion 174 drops below the feed latch 180 (FIGS. 8-9), allowing the back end of the feed latch to pivot over the latch release 170 to unblock the additional rounds waiting within the magazine.

Figure 8:
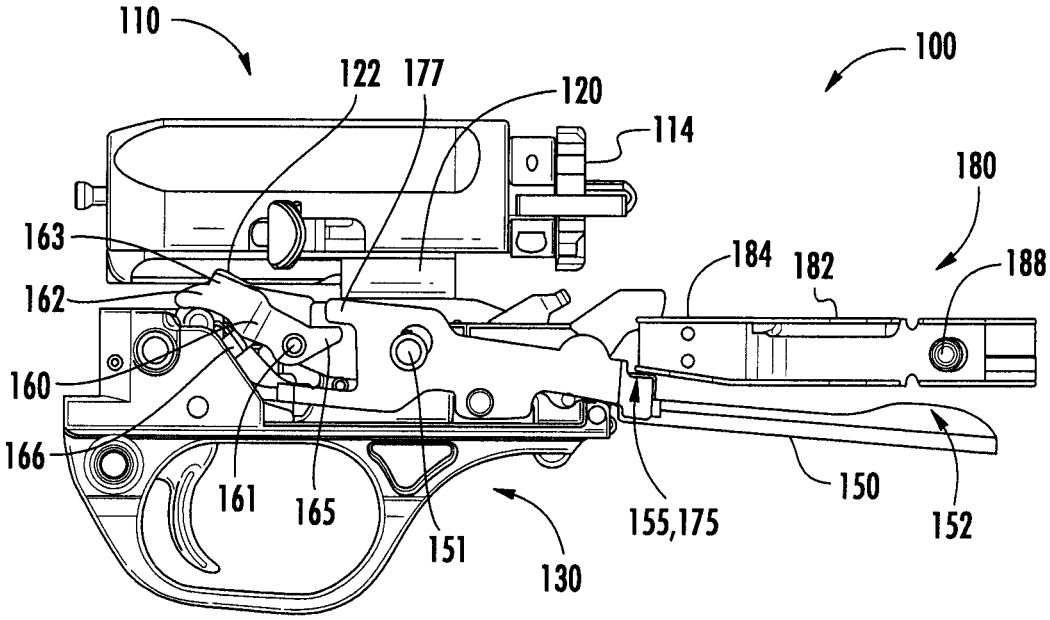
FIG. 8 is a side view of the trigger plate, bolt, and feed latch assemblies of the fire control mechanism of FIG. 2 in the first, manually-operated configuration.
Figure 9:
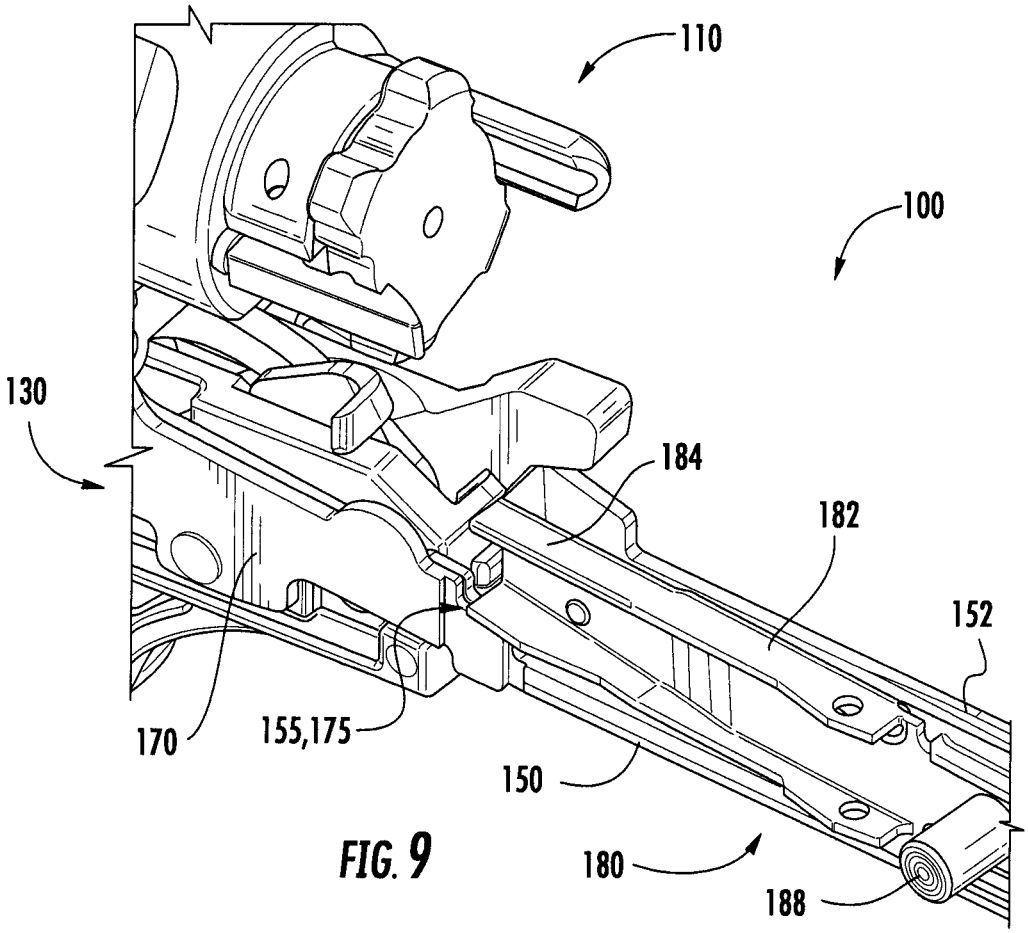
FIG. 9 is a perspective view of the trigger plate, bolt, and feed latch assemblies of the fire control mechanism of FIG. 2 in the first, manually-operated configuration.

FIGS. 8 and 9 are side and perspective views, respectively, of the isolated trigger plate assembly 130, the bolt assembly 110 and the feed latch 180 of the fire control mechanism 100 in the first manually-operated configuration as discussed above. As can be seen in these drawings, the back end 184 of the latch body 182 has rotated, or pivoted, over the lower step 175 in the latch release 170 and a lower step 155 (FIG. 7) in the carrier 150. Thus, the interaction between the toe 165 of the carrier dog 160 and the catch 177 of the latch release 170 automatically causes the carrier dog 160 to kick the latch release 170 during manual cycling of the fire control 100, instead of having the shooter manually activate an external button or lever.

With back end 184 of the feed latch 180 rotated inwardly over both the lower step 155 of the carrier and the lower step 175 in the latch release, as shown in FIGS. 8-9, the carrier 150 is prevented from rotating around the carrier pivot tube 151. Consequently, the carrier dog pivot pin 161 at the opposite end of the carrier 150, which rotatably couples the carrier dog 160 to the carrier 150, remains in an elevated position, causing the projecting tab 163 in the upper end 162 of the carrier dog 160 to become engaged within the locking notch 122 formed into the lower surface of the bolt carrier 120. While the bolt springs (not shown) bias the bolt assembly 110 forwardly, this engagement can substantially lock the bolt assembly 110 in the open position until the occurrence of other event or action.

As will be understood by those skilled in the art, when an additional round (not shown) is present in the magazine and fed from the magazine onto the lifting portion 152 of the carrier 150, the raised lip at the base end of the round has a diameter generally sized to engage and urge the back end 184 of the feed latch 180 outwardly so that it no longer covers the lower step 155 of the carrier 150 or the lower step 175 of the latch release 170. With the carrier 150 again free to rotate about the carrier pivot tube 151, the biasing forces on the bolt assembly 110 are released to operate on the projecting tab 163, pushing the carrier dog 160 and carrier dog pivot pin 161 downward and out of the way as it slides forward. This simultaneously rotates the carrier 150 in the counterclockwise direction to lift the fresh round on the lifting portion 152 upwards toward the chamber.

As a result, manually cycling the fire control 100 to a first manually-operated configuration can have two outcomes, depending on whether or not there is an additional round stored in the magazine. First, if there is an additional round in the magazine, cycling the fire control open by pulling back on the bolt lever 118 both ejects the round currently in the chamber and causes the toe 165 of the carrier dog 160 to move the latch release 170 and trip open the feed latch 180. This allows the next round to feed onto the lifting portion 152 of the carrier 150 and to push the feed latch 180 back into its original position to block any additional rounds from leaving the magazine. Releasing the bolt lever 118 allows the bolt assembly 110 to move forward to push against the projecting tab 163 in the carrier dog 160, thereby rotating the carrier 150 in a counterclockwise direction to lift the fresh round of ammunition on the lifting portion 152 up to the chamber, where it is captured and moved fully into the chamber by the forward-moving bolt assembly 110 as it completes the cycle and returns to its forward and locked, ready-to-fire position shown in FIG. 3.

If there are no additional rounds in the magazine, pulling back on the bolt lever 118 again causes the toe 165 of the carrier dog 160 to move the latch release 170 and trip open the feed latch 180. However, with no additional round to rotate the back end 184 of the feed latch 180 outwards, the lower step 155 of the carrier 150 is blocked from moving by the underside of the feed latch 180. This in turn locks the bolt assembly 110 in the open position against the projecting tab 163 of the carrier dog 160. To release the bolt assembly 110 from its open and locked position, the shooter can press on the release button 188 of the feed latch 180. This causes the back end 184 of the feed latch to pivot outward and clear the carrier 150, thus allowing the bolt assembly 110 to push the carrier dog 160 down and out of the way as it slides forward to lock into an empty chamber. A spring in the carrier dog plunger 166 generally causes the carrier dog 160 and carrier 150 to return to their original, ready-to-fire positions, while a latch release spring (not shown) on the opposite side of the trigger plate assembly 130 biases the latch release 170 to rotate counter-clockwise back to its original position blocking the back end 184 of the feed latch 180 (see FIG. 3).

Figure 10:
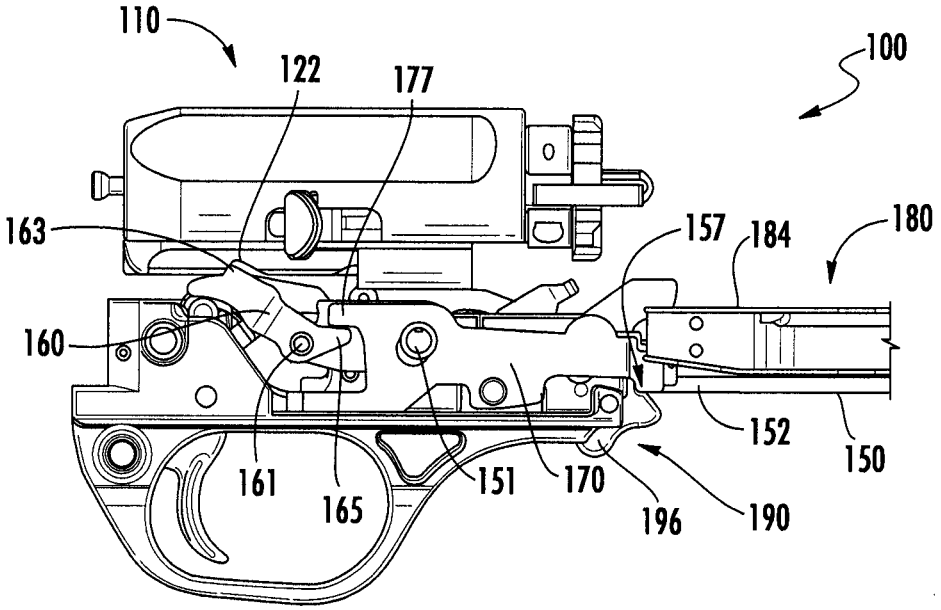
FIG. 10 is a side view of the trigger plate, bolt, and feed latch assemblies of the fire control mechanism of FIG. 2 in a second, manually-operated configuration.

Referring now to FIG. 10, the fire control mechanism 100 of the present disclosure also includes a magazine cutoff 190 located near the forward end of the trigger plate assembly 130. The magazine cutoff 190 can be used to position the carrier 150 in a variety of positions which can affect the position and operation of both the carrier dog 160 and the bolt assembly 110, as well as the feed latch 180. For example, with the first manually-operated configuration discussed above with reference to FIGS. 6-9, the magazine cutoff 190 is in a first, rearmost, and disengaged position in which the magazine cutoff 190 does not interact with the carrier 150.

As shown in FIG. 10, the lifting portion 152 of the carrier 150 can be lifted slightly so that the rear edge 157 of the lifting portion 152 may be positioned within a notch 192 (see FIG. 14) formed into the forward portion of the magazine cutoff 190 as the magazine cutoff 190 is moved forward into a second manually-operated configuration. Engaging the magazine cutoff 190 around the raised interior edge 157 of the lifting portion 152 has the affect of both locking the carrier 150 against further rotation, and of slightly lowering the carrier dog pivot pin 161 at the opposite end of the carrier 150. This repositioning of the center of rotation of the carrier dog 160 reduces or substantially eliminates the contact between the toe 165 of the carrier dog 160 and the catch 177 of the latch release 170 when the bolt assembly 110 is pulled backwards to its open position. As a result, the carrier dog 160 does not engage the latch release 170 or cause it to rotate downwardly. Instead, the latch release 170 remains in its normal position blocking the rotation of the feed latch 180, as shown in FIG. 10, so that the feed latch 180 continues in its normal position blocking any additional rounds in the magazine from feeding into the lifting portion 152 of the carrier 150.

In addition, with the raised interior edge 157 of the lifting portion 152 being captured within the notch 192 of the magazine cutoff 190 to prevent any movement of the carrier 150, the notch 122 of the bolt carrier 120 is again caught on the projecting tab 163 of the carrier dog 160 to lock the bolt assembly 110 in the open position. Consequently, engaging the notch 192 in the magazine cutoff 190 around the rear edge 157 of the lifting portion 152 enables the shooter to manually eject the round in the chamber while locking the bolt assembly 110 in the open position, even when there are additional rounds in the magazine. This mode of manual operation can be useful to the shooter for unloading the firearm and placing it is a safe and locked-open condition prior to crossing a fence or obstacle.

The bolt assembly 110 can be released from the locked-open condition by pulling back on the finger tab 196 of the magazine cutoff 190 to cause the notch 192 to slide out from around the rear edge 157 of lifting portion 152. This frees the carrier 150 to rotate about the pivot tube 151 as the bolt assembly 110 pushes the carrier dog 160 down and out of the way as it moves forward to lock around the chamber. The chamber will be empty unless the shooter has re-chambered a round into the firearm prior to pulling back on the finger tab 196 and releasing the carrier 150.

The structure and operation of the magazine cutoff 190 is disclosed in greater detail in co-pending U.S. patent application Ser. No. 13/345,256, filed Jan. 6, 2012, and which application is incorporated by reference for all purposes in its entirety herein.

Figure 11:
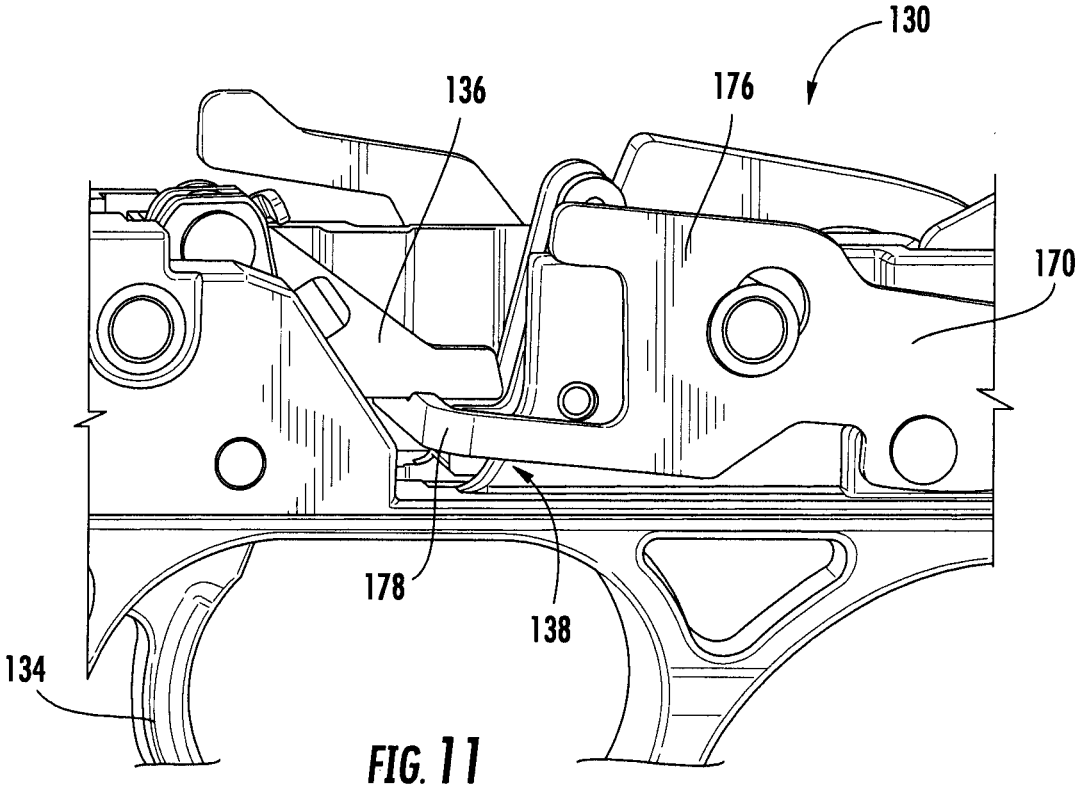
FIG. 11 is a perspective view of the latch release of the fire control mechanism of FIG. 2, shown in a trigger-disconnect position.
Figure 12:
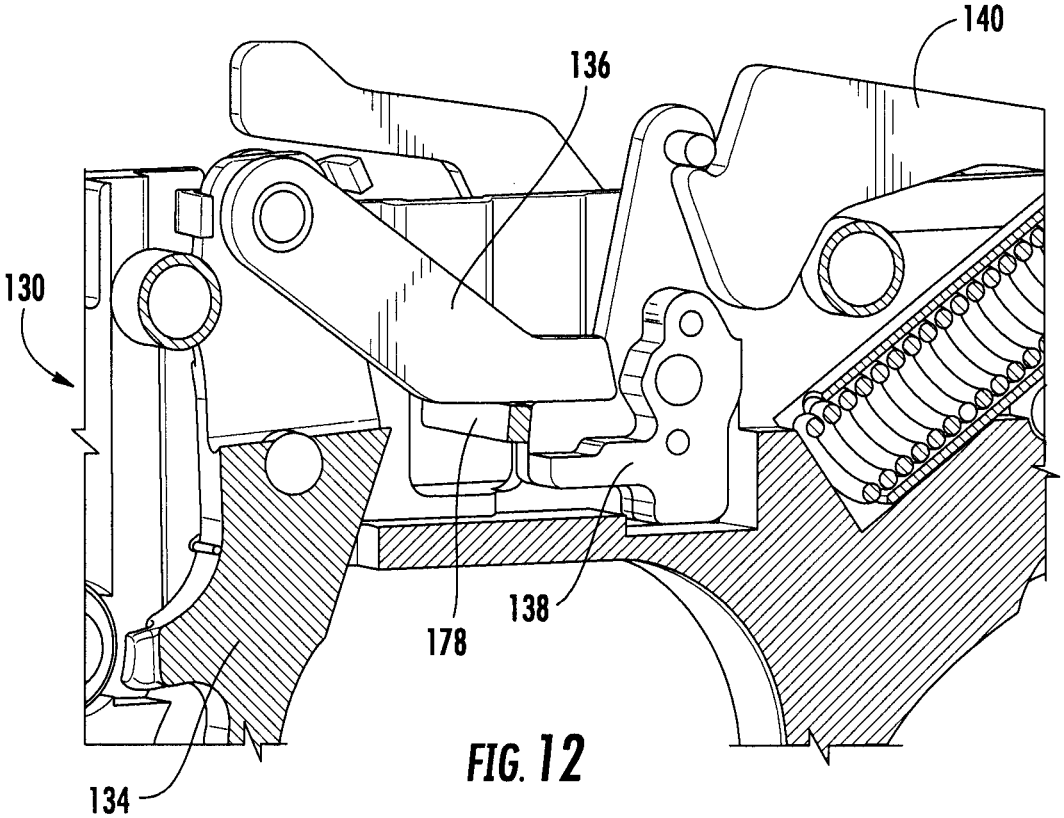
FIG. 12 is a cut-away perspective view of the latch release, trigger connector, and sear of the fire control mechanism of FIG. 2, shown in a trigger-disconnect position.
Figure 13:
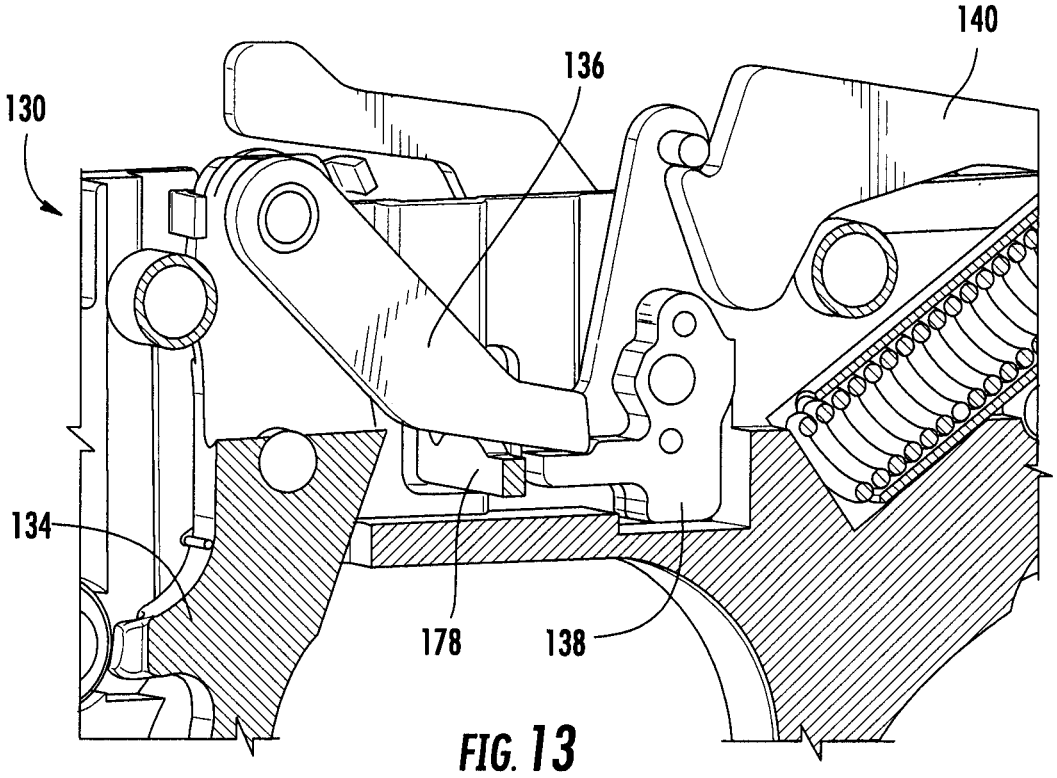
FIG. 13 is a cut-away perspective view of the latch release, trigger connector, and sear of the fire control mechanism of FIG. 2, shown in a ready-to-fire position.

Another aspect of the present disclosure is illustrated in FIGS. 11-13, wherein the back end 176 of the latch release 170 also includes a disengagement portion 178 extending inwardly through the trigger plate assembly 130. With several of the overlying components removed for illustrative purposes, it can be seen in FIGS. 11 and 12 that the disengagement portion 178 presses upward against the bottom surface of the trigger connector 136 to lift the connector 136 away from the sear 138 when the latch release 170 is rotate downwards under the influence of either the latch release lever or the carrier dog, as described above. Once the latch release 170 has returned to its ready-to-fire position, as shown in FIG. 13, the disengagement portion 178 is positioned well below the trigger connector 136 to allow its normal operation when the trigger 134 is pulled to release the hammer 140 and fire the firearm.

Figure 14:
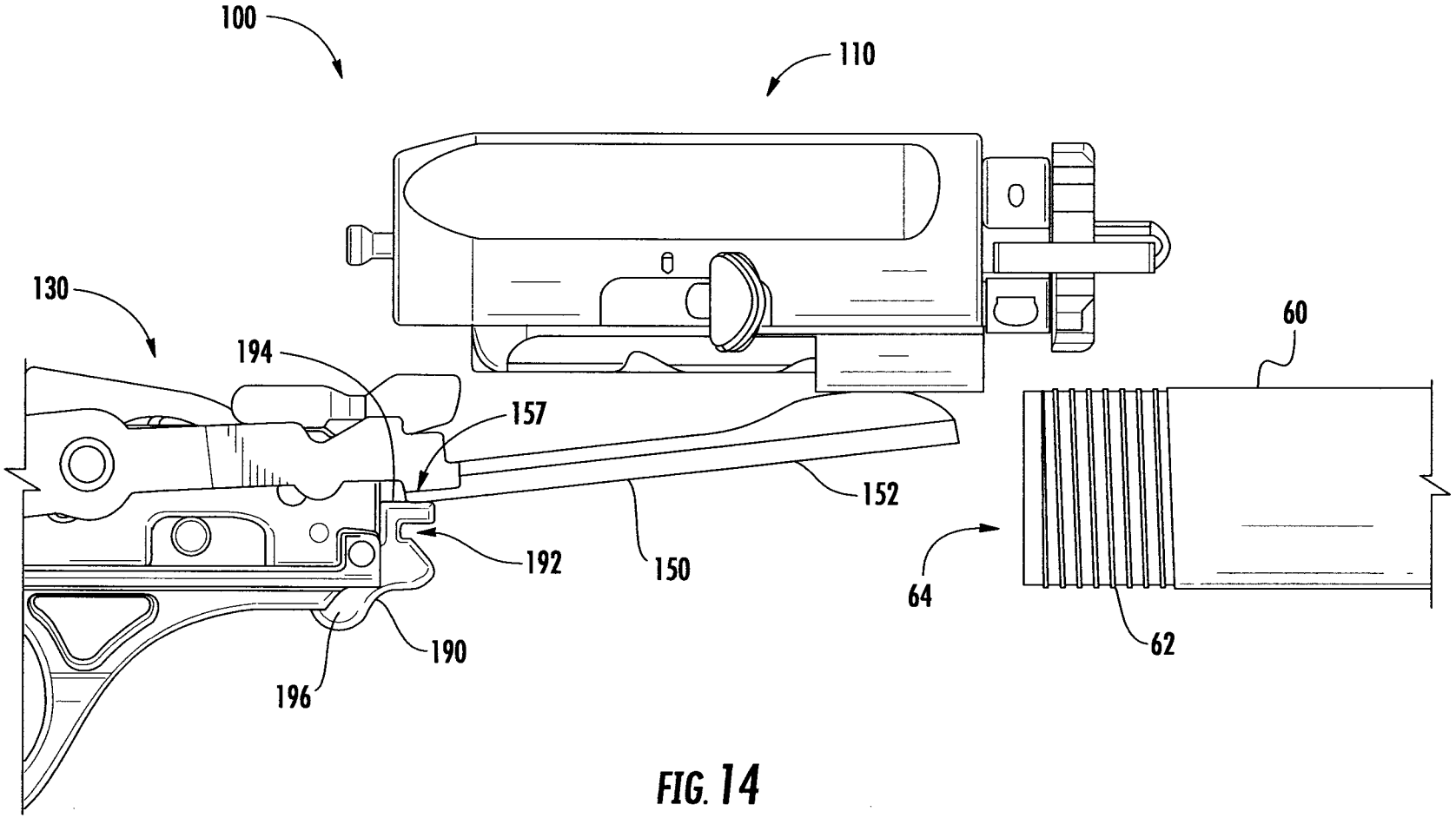
FIG. 14 is an exploded side view of the trigger plate assembly, bolt assembly, and magazine of the fire control mechanism of FIG. 2 in a third, manually-operated configuration.

FIG. 14 is a side view of the isolated trigger plate assembly 130, the bolt assembly 110, and the magazine assembly 60 of the fire control mechanism 100 of FIG. 2 in a third manually-operated configuration. In this arrangement, the lifting portion 152 of the carrier 150 has been rotated further upward into the base of the receiver and the magazine cutoff moved forward so that the rear edge 157 of the lifting portion 152 is resting on the top surface 194 of the magazine cutoff 190. With the lifting portion 152 of the carrier 150 locked in the fully-raised position, the opening 64 in the back end 62 of the magazine 60 is largely open and unblocked, requiring only minor additional movements to either feed rounds into the magazine or to withdraw rounds from the magazine. Thus, placing the fire control mechanism 100 into the third manually-operated configuration allows for additional rounds of ammunition to be easily loaded into the magazine 60, even by a shooter wearing gloves.

Figure 15:
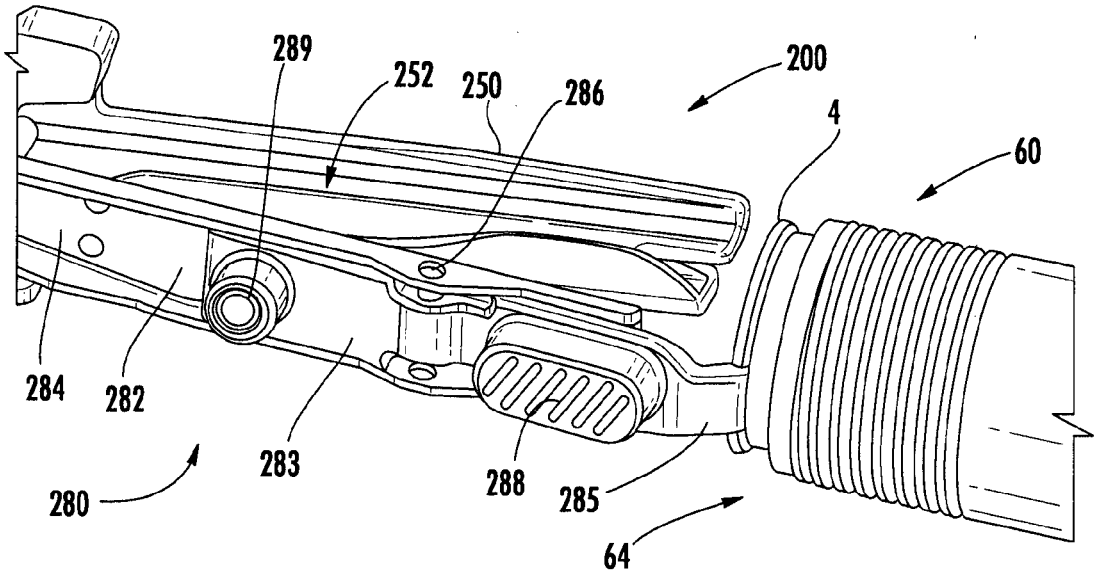
FIG. 15 is a perspective side view of the feed latch assembly and magazine of the fire control mechanism, in accordance with an additional representative embodiment.
Figure 16:
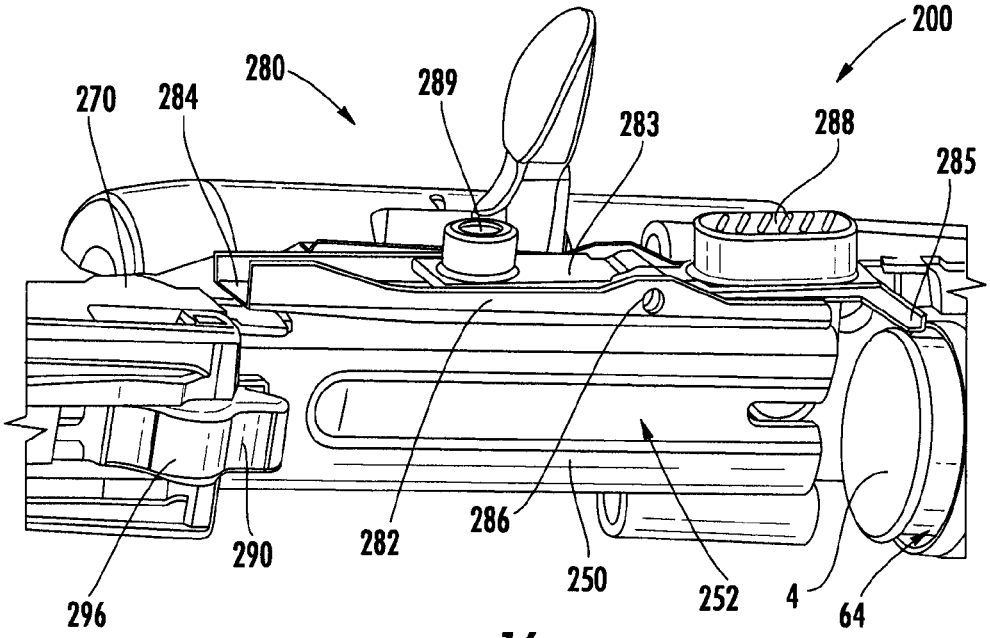
FIG. 16 is a perspective bottom view of the fire control mechanism of FIG. 15.

FIGS. 15 and 16 show another representative embodiment of the fire control mechanism 200 of the present disclosure having a two-piece feed latch assembly 280. The two-piece feed latch assembly 280 includes an inner latch body 282 having a back end 284 which rotates into the receiver to lock over the latch release 270 and the carrier 250, similar to the action described above with reference to FIGS. 8-9. The feed latch assembly 280 also includes an outer pivoting body 283 having a forward end 285 which blocks the release of rounds 4 from the opening 64 in the back end of the magazine 60. During normal operation, the inner latch body 282 and the outer pivoting body 283 rotate about pivot point 286 in unison to control the feeding of the additional rounds 4 in the magazine 60 onto the lifting portion 252 of the carrier 250. For instance, the large release button 288 in the forward portion of the feed latch 280 can be depressed when the bolt assembly is locked in an open position, such as after firing the last round in the firearm. As described above, pressing the release button 288 will cause the back end 284 of the inner latch body 282 to rotate outwardly to free the carrier 250 and the latch release 270. The carrier 250 is then allowed to rotate about the carrier pivot tube as the bolt assembly pushes the carrier dog and downward and out of the way as it returns to the closed position.

For loading and unloading scenarios, the two-piece feed latch assembly 280 includes an additional speed release button 289 having a coil spring enclosed therein. Depressing the speed release button 289 causes the outer pivoting body 283 to rotate independently from the inner latch body 282 and to unblock the opening 64 in the magazine 60. This can be accomplished even when the back end 284 of the feed latch body 282 is blocked from rotation by the latch release 270. Consequently, the rounds 4 in the magazine 60 can be more easily removed and/or loaded into the magazine.

When used in conjunction with the magazine cutoff 290 and the carrier 250 in the third manually-operated configuration shown in FIG. 14 (i.e., with the rear edge of the lifting portion resting on the top surface of the magazine cutoff), the speed release button 289 can be depressed and the barrel of the gun elevated until the rounds 4 in the magazine 60 simply slide out of the opening 64 under the influence of gravity and the magazine spring. As may be appreciated, this arrangement can facilitate the removal of one set of ammunition to be replaced with ammunition of a different type which is more appropriate for new set of conditions, and may be easily accomplished by a shooter wearing gloves.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed:

1. A firearm comprising:
a barrel having a chamber;
a bolt assembly;
a magazine for supplying a round of ammunition to the chamber; and
a trigger plate assembly for controlling the movement of the round of ammunition between the magazine and the chamber of the firearm, the trigger plate assembly comprising:
a carrier operable to direct a round of ammunition into the chamber;
a latch release movable into engagement with a feed latch and operable to direct the release of a round of ammunition from the magazine onto the carrier;
a carrier dog configured for communication with the carrier and with the latch release during operation of the bolt assembly; and
a latch release lever movable into engagement with the latch release during firing of the firearm;
wherein movement of the bolt assembly upon firing of the firearm causes the latch release lever to engage the latch release to allow the feed latch to release the round of ammunition onto the carrier and the carrier dog to move the carrier to transfer the round of ammunition into the chamber, and
wherein manual activation of the bolt assembly causes the carrier dog to engage the latch release to allow the feed latch to release the round of ammunition onto the carrier and the carrier to direct the round of ammunition into the chamber.

2. The firearm of claim 1, the trigger plate assembly further comprising a magazine cutoff selectively movable between a first position allowing substantially free movement of the carrier and a second position directing the carrier to a substantially centered orientation.

3. The firearm of claim 2, wherein manual activation of a fire control with the magazine cutoff in the second position causes the carrier to reposition the carrier dog to prevent engagement of the latch release and to substantially lock the fire control in an open position.

4. The firearm of claim 3, wherein a subsequent movement of the magazine cutoff to the first position releases the carrier dog to allow the fire control to return to a closed position without a round being released from the magazine.

5. The firearm of claim 2, wherein the magazine cutoff is selectively movable to a third configuration to secure the carrier in a raised orientation that opens the magazine of the firearm to enable substantially unrestricted access thereto to facilitate the loading of rounds into the magazine and the unloading of rounds from the magazine.

6. A firearm comprising:
a barrel having a chamber;
a magazine; and
a fire control including:
a bolt assembly;
a feed latch moveable between a position blocking release of a round of ammunition from the magazine and a position allowing release of the round of ammunition from the magazine onto the carrier, and/or release of the bolt assembly from a locked open position; and
a trigger plate assembly comprising:
a trigger;
a hammer initiating firing of the round of ammunition upon movement of the trigger;
a hammer plunger configured to urge the hammer into a position for firing the round of ammunition;
a carrier configured to direct the round of ammunition from the magazine into the chamber;
a movable latch release configured to engage the feed latch so as to substantially block movement of the feed latch over the carrier; and a latch release lever movable into engagement with the latch release by the hammer plunger so as to move the latch release to a position enabling the feed latch to move to an open position for releasing the round of ammunition onto the carrier for feeding the round of ammunition into the chamber during firing of the firearm.

7. The firearm according to claim 6, wherein the fire control further comprises a carrier dog configured to engage the latch release to allow the feed latch to release the round of ammunition onto the carrier and the carrier to direct the round of ammunition into the chamber during manual operation of the bolt assembly.

8. The firearm according to claim 6, wherein the latch release comprises one or more engaging surfaces configured to contact at least a portion of the feed latch.

9. A firearm, comprising:

a barrel defining a chamber configured to hold a shell;

a receiver coupled to the barrel;

a bolt assembly disposed in the receiver and having a bolt body that rides on an axial reciprocating bolt carrier so as to be movable along the receiver, the bolt body configured to cooperate with the barrel so as to seal the chamber during firing;

a magazine configured to retain a plurality of shells for feeding shells into the chamber;

a carrier movably positioned between a lowered position to receive the shells from the magazine and an upward position to feed the shells into the chamber;

a carrier dog rotatably coupled to the carrier and positioned to engage the bolt carrier;

a feed latch pivotable to engage and lock the carrier in the lowered position;

a latch release movably positioned to be engaged by the carrier dog and movable into engagement with the feed latch; and a latch release lever movable into and out of engagement with the latch release, wherein, during manual cycling of the bolt assembly, the latch release lever does not engage the latch release, and the carrier dog is rotated into engagement with the latch release so as to activate or disengage the feed latch.

* * * * *